US007182011B2

(12) United States Patent
Lowery et al.

(10) Patent No.: US 7,182,011 B2
(45) Date of Patent: Feb. 27, 2007

(54) MINE RETRIEVAL METHOD AND APPARATUS

(75) Inventors: Brett R Lowery, Farnborough (GB); Thomas J Packard, Salisbury (GB)

(73) Assignee: Qinetiq Limited, Farnborough (GB)

( * ) Notice: Subject to any disclaimer, the term of this patent is extended or adjusted under 35 U.S.C. 154(b) by 401 days.

(21) Appl. No.: 10/467,619

(22) PCT Filed: Feb. 4, 2002

(86) PCT No.: PCT/GB02/00488

§ 371 (c)(1),
(2), (4) Date: Aug. 8, 2003

(87) PCT Pub. No.: WO02/066920

PCT Pub. Date: Aug. 29, 2002

(65) Prior Publication Data

US 2004/0069508 A1 Apr. 15, 2004

(30) Foreign Application Priority Data

Feb. 16, 2001 (GB) ..... 0103844.7

(51) Int. Cl.
*B63G 7/02* (2006.01)

(52) U.S. Cl. ..... 89/1.13

(58) Field of Classification Search ..... 89/1.13
See application file for complete search history.

(56) References Cited

U.S. PATENT DOCUMENTS

| | | | | |
|---|---|---|---|---|
| 1,841,802 | A * | 1/1932 | Gettelman | 299/37.4 |
| 5,448,937 | A | 9/1995 | Buc et al. | |
| 5,785,038 | A * | 7/1998 | Mattern | 124/56 |
| 5,856,629 | A | 1/1999 | Grosch et al. | |
| 6,199,793 | B1 * | 3/2001 | Hainsworth et al. | 244/1 TD |
| 6,216,540 | B1 * | 4/2001 | Nelson et al. | 73/633 |
| 6,298,763 | B1 | 10/2001 | Greenfield et al. | |
| 6,363,828 | B1 * | 4/2002 | Sherlock et al. | 89/1.13 |

FOREIGN PATENT DOCUMENTS

DE 38 26 731 A 2/1990

OTHER PUBLICATIONS

Patent Abstracts of Japan, vol. 2000, No. 07, Sep. 29, 2000, & JP 2000 097598 A (Mogi Yasuhito; Sugawara Akio; Ishikawa Sumio; Wako Steel KK), Apr. 4, 2000.

* cited by examiner

*Primary Examiner*—Stephen M. Johnson
(74) *Attorney, Agent, or Firm*—Nixon & Vanderhye P.C.

(57) ABSTRACT

The invention relates to the field of land mines and in particular to devices and techniques for neutralising and/or retrieving land mines. Existing mine retrieval/neutralisation techniques include mechanical excavation or shaped charge attack and such techniques are either susceptible to blast damage in the event of inadvertent mine explosion or can produce ambiguous results (i.e. an operator can be unsure as to whether a mine has been successfully attacked or a non-mine target has been attacked in error). The present invention provides a mine retrieval technique that involves spearing the mine for later retrieval to the surface.

9 Claims, 3 Drawing Sheets

MINE RETRIEVAL METHOD AND APPARATUS

Figure 1:
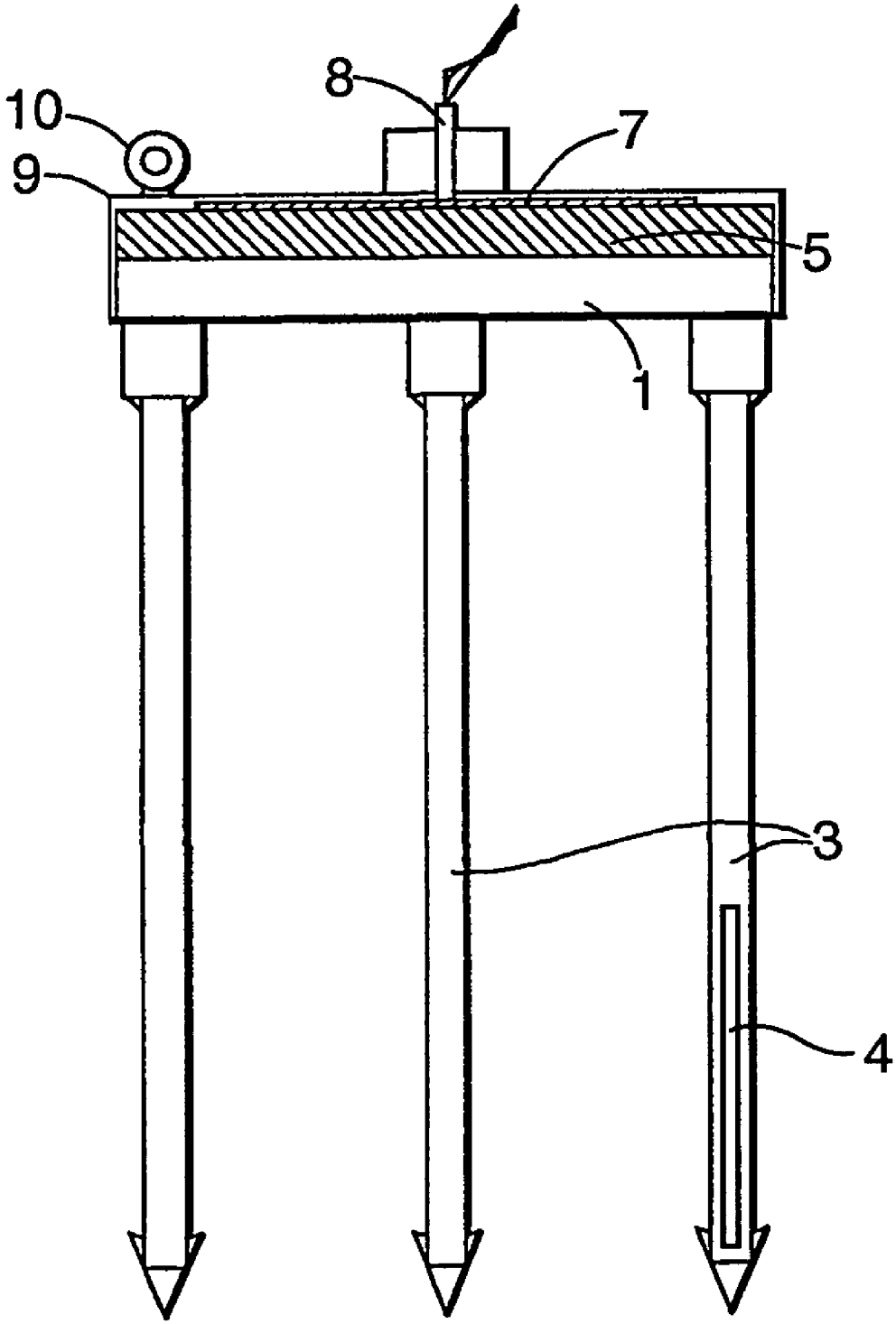

This application is the US national phase of international application PCT/GB02/00488 filed 4 Feb. 2002, which designated the US.

This invention relates to the field of land mines and in particular to the devices and techniques for neutralising/retrieving mines.

Land mines can be buried or surface laid. A surface laid mine does not present a major problem to an Explosives Ordnance Disposal (EOD) technician since it can be attacked and neutralised from a safe stand-off distance, e.g. by means of a projectile, pyrotechnic torch or other suitable means. Buried mines, however, present more of a problem.

Anti-personnel mines are generally fairly close to the surface but anti-tank mines can be up to 300 mm from the surface. Current techniques for neutralising buried mines include mechanical excavation or shaped charge attack.

Mechanical excavators simply dig mines out of the ground ready for subsequent disposal or attack Such systems are vulnerable to blast damage in the event of an inadvertent explosion.

Shaped charge attack neutralisation techniques aim to initiate mines by imparting energy into the explosive component of the mine. If no reaction occurs then the EOD technician does not know whether a non-mine target has been attacked in error, the mine has been missed or insufficient energy has been imparted to the explosive contents of the mine.

It is therefore an object of the present invention to provide a method of mine neutralisation/retrieval (and devices therefor) that substantially mitigates or overcomes the above mentioned problems.

Accordingly the invention provides a method of retrieving a buried mine comprising the steps of:

i) locating a mine to be retrieved;

ii) propelling a mine retrieval device toward the mine to be retrieved, the mine retrieval device comprising at least one "mine penetrating" spike supported on a base plate, such that the mine is penetrated and engaged by at least one spike, and;

iii) retrieving the mine retrieval device and mine.

Correspondingly the invention provides a mine retrieval device comprising a base plate, at least one mine penetrating spike, the at least one spike being supported by the base plate and being capable in use of penetrating and engaging a mine and propelling means being capable in use of propelling the base plate and the at least one spike towards a mine with sufficient velocity to enable the mine to be penetrated The invention provides a method of mine retrieval which consists of spearing (or "skewering") the mine with one or more spikes. In this case, the mine neutralisation device basically comprises a base (flyer) plate to which are attached a number of spikes. In use the flyer plate (and therefore the spikes) is propelled into the ground so that the spikes penetrate the soil and spear any target in their path. This will either cause detonation of the mine by activation of the mine's fuze or, in the case of non-detonation of the mine, will allow the mine to be recovered from the ground for subsequent disposal, e.g. by a pyrotechnic torch. As well as supporting the spikes the base plate also serves to arrest the motion of the spikes once they have reached a pre-determined depth.

There are a number of different ways in which the base plate and spikes can be propelled. Conveniently, an explosive or propellant can be used. In order to avoid shock initiation of the mine the base plate and spikes should have a low velocity, of the order of a few tens of m/s. Alternatively, a compressed air system can be used to propel the spike system.

A sheet explosive (such as SX2) can be used to propel the base plate and spikes and has the additional benefit that this provides a volume efficient device. In this case a sheet of explosive is placed on the side of the base plate facing away from the ground. Polystyrene spacers placed between the sheet explosive and base plate can conveniently be used to alter the speed at which the base plate/spike arrangement is propelled into the ground.

Preferably the spikes should be barbed in order to securely engage the mine. Conveniently the tip of the spikes can incorporate a chemical capsule which is designed to break during mine penetration and initiate a low order reaction of the explosive compound in the mine.

Preferably the device further comprises a means for retrieving the base plate, spikes and mine. Conveniently, the base plate can be connected to a cable which can then be used to retrieve the device, e.g. by using a winch.

In order to provide a safe stand-off distance for operating personnel and vehicle the device can be launched from a simple boom arm.

Embodiments of the present invention will now be described, by way of example, with reference to the accompanying drawings, wherein FIGS. 1–6 show a method of mine retrieval/neutralisation (and mine neutralisation device) according to the present invention.

Turning to FIG. 1, a mine retrieval device according to the present invention is shown. A base plate 1 supports a number of spikes 3 and one or more of the spikes may optionally include a chemical capsule 4 containing a chemical for initiating a low order reaction of the explosive in the mine. A polystyrene spacer 5 separates the base plate 1 from an explosive sheet 7 in order to stop shock loading of the base plate 1. The thickness of the polystyrene spacer can be varied in order to change the velocity at which the base plate is propelled towards the ground. The explosive 7 is connected to a detonator 8. A support structure 9 carries the plate, spike and explosive assembly. Means for retrieving the device after use is provided by the retrieval eye 10 which can be connected to a cable and winch.

Suitable explosives include SX2 which is readily available in sheet form. The size of the explosive sheet and its stand-off from the base plate can be varied in order to give the system the necessary energy to penetrate the ground and mine.

Figure 2:
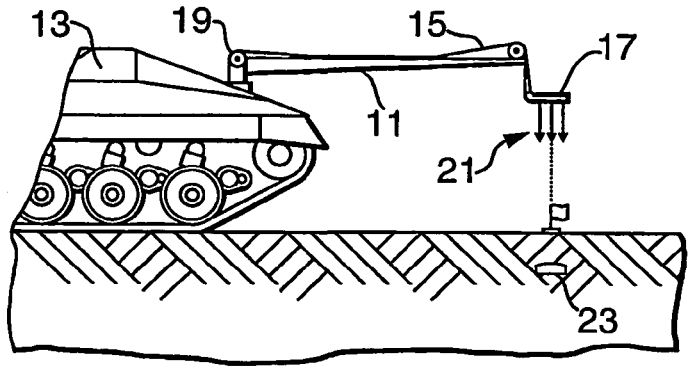
Figure 3:
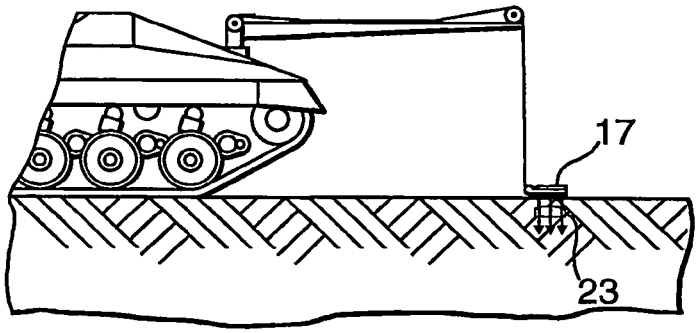
Figure 4:
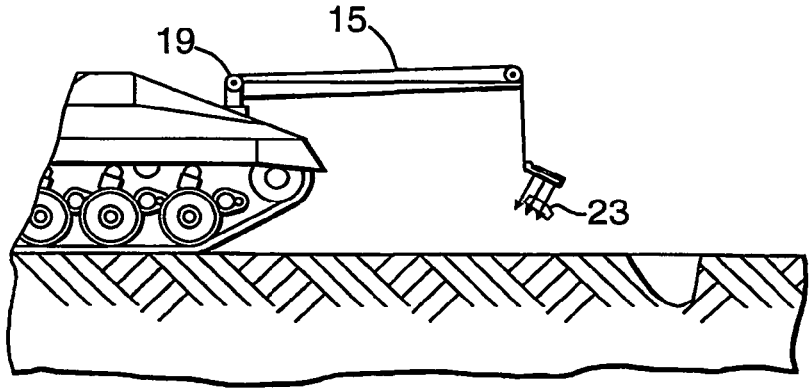

FIG. 2 shows the mine neutralisation/retrieval device of FIG. 1 being carried on a supporting boom arm 11 which is in turn attached to a vehicle 13. A cable 15 is attached at one end to the mine neutralisation/retrieval device 17 and at the other end to a winch 19. The mine neutralisation/retrieval device comprises a number of spikes 21 which are geometrically arranged on the base plate so that the device has a large area of attack and so that the probability of a successful mine attack is increased. However, the skilled man will appreciate that a number of different configurations for the spikes can be chosen. For example, if the mine's location is accurately known then a single spike variant can be used to attack the periphery of the mine away from the central fuze thereby reducing the probability of accidental mine initiation.

In use, the device is positioned above a mine 23 which has previously been located by, for example, ground penetrating radar or metal detection. The propelling system is then activated and the mine is speared (see FIG. 3).

If no target reaction occurs then the speared target can be pulled to the surface, identified and subsequently dealt with. For example, in FIG. 4, the cable 15 and winch 19 system is used to pull the mine 23 from the ground.

Figure 5:
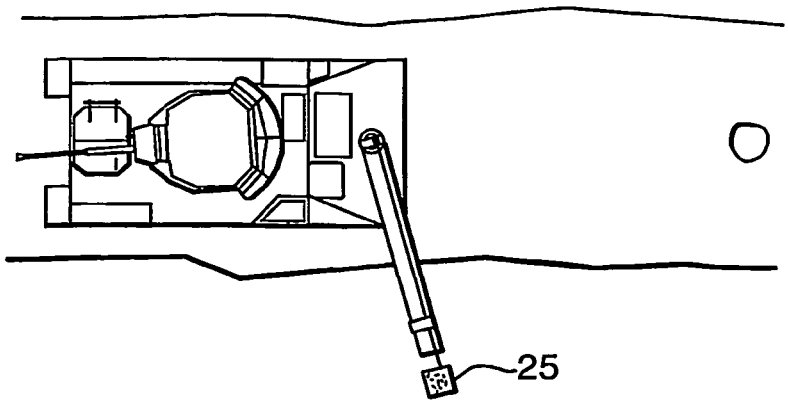

Once the mine has been removed from the ground the supporting arm can then be moved to allow the mine neutralisation/retrieval device and the mine itself to be jettisoned in a location 25 from which the mine's destruction can more safely be performed (see FIG. 5).

Figure 6:
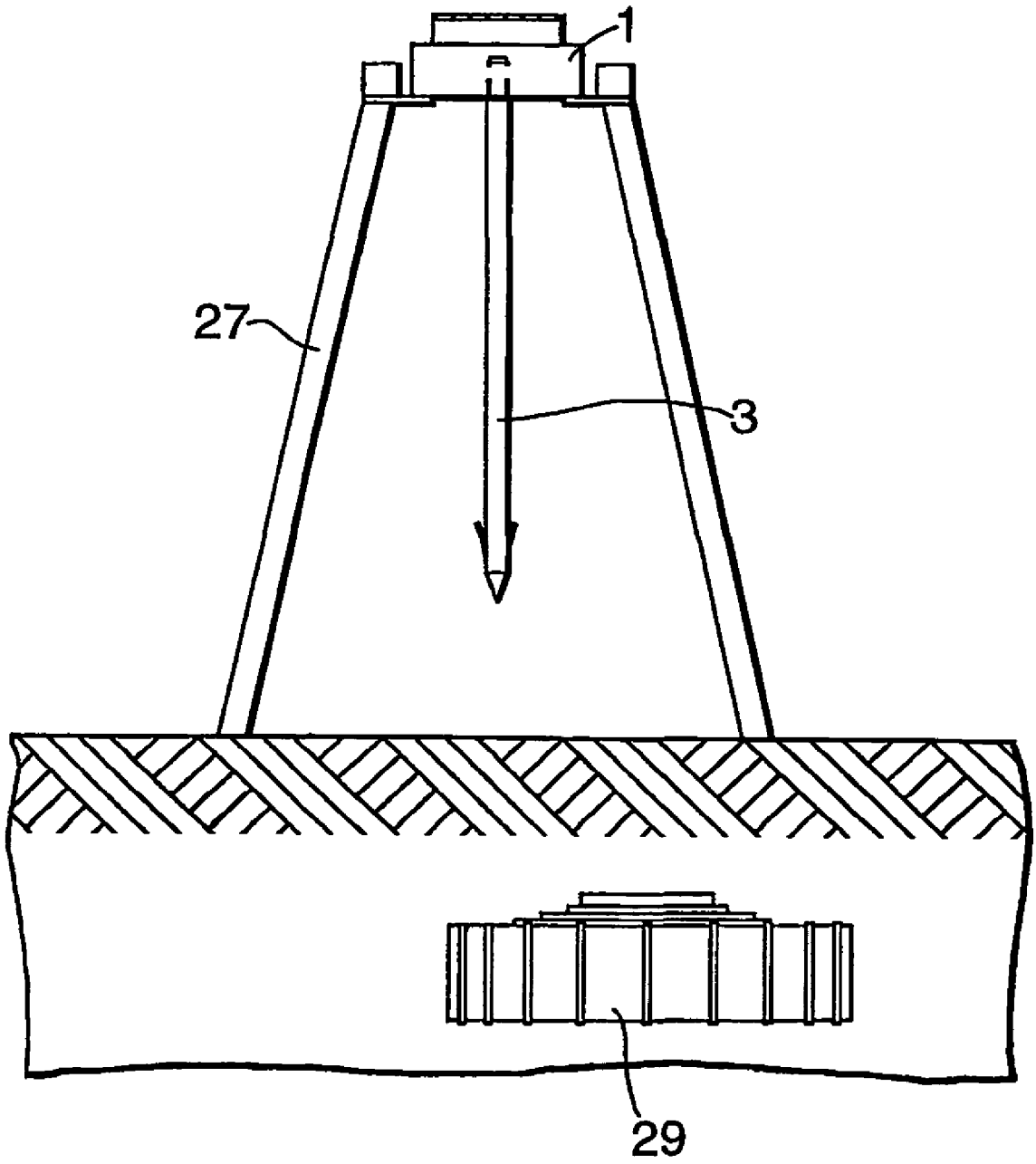

FIG. 6 shows an alternative way of deploying the mine device according to the invention. The figure shows a single spike variant of the device shown in FIG. 1 (like numerals denote like features between FIGS. 1 and 6). In this case the spike 3 and base plate 1 are mounted upon a frame 27 such that the spike 3 points vertically downwards.

In use the device is placed above a mine 29 to be removed. A robot can conveniently be used to deliver the device to the location of the mine. The device is placed such that the spike is aimed slightly away from the centre of the mine 29. This therefore avoids the fuzing system and reduces the risk of accidentally activating the mine when the mine neutralisation device is activated.

It will be clear to the skilled man that a plurality of spikes could be used (as opposed to a single spike as shown) and that the device could be delivered into the ground at an angle from the vertical if more convenient.

The invention claimed is:

1. A method of retrieving a buried mine comprising the following steps:

i) locating a mine to be retrieved;

ii) propelling a mine retrieval device toward the mine to be retrieved, the mine retrieval device comprising at least one mine penetrating spike supported on a base plate, such that the mine is penetrated and engaged by said at least one spike, and;

iii) retrieving the mine retrieval device and said mine.

2. A mine retrieval device comprising:

a base plate;

at least one mine penetrating spike, the at least one spike being supported by the base plate and capable of penetrating and engaging a mine;

propelling means for propelling the base plate and the at least one spike towards said mine with sufficient velocity to enable the mine to be penetrated; and retrieval means for retrieving the base plate, the at least one spike and the mine after the mine has been penetrated.

3. A mine retrieval device as claimed in claim 2 wherein the propelling means is a sheet explosive.

4. A mine retrieval device as claimed in claim 2 wherein the propelling means is compressed air system.

5. A mine retrieval device as claimed in claim 2 wherein the at least one spike is barbed.

6. A mine retrieval device as claimed in claim 2 wherein the tip of the at least one spike contains a chemical capsule, said capsule being arranged in use to break during penetration of said mine in order to release a chemical capable of initiating a low order reaction of the mine's explosive components.

7. A mine retrieval device as claimed in claim 2 wherein the retrieval device comprises a winch and cable.

8. A mine retrieval device as claimed in claim 2 wherein the base plate and the at least one spike are launched from a boom arm.

9. A mine retrieval device as claimed in claim 2 wherein the base plate and the at least one spike are launched from a frame.

* * * * *